US006612146B2

(12) United States Patent
Saint Denis et al.

(10) Patent No.: US 6,612,146 B2
(45) Date of Patent: Sep. 2, 2003

(54) HEMMING MACHINE WITH MOVABLE DIE CARTRIDGES

(75) Inventors: Kenneth Saint Denis, Tecumseh, CA (US); Ray Cote, Windsor, CA (US); Louis Raffin, Windsor, CA (US); Lee Harrison, Windsor, CA (US)

(73) Assignee: Valiant Corporation (CA)

( * ) Notice: Subject to any disclaimer, the term of this patent is extended or adjusted under 35 U.S.C. 154(b) by 0 days.

(21) Appl. No.: 09/999,811

(22) Filed: Oct. 24, 2001

(65) Prior Publication Data

US 2002/0170333 A1 Nov. 21, 2002

Related U.S. Application Data

(63) Continuation-in-part of application No. 09/861,067, filed on May 18, 2001, now Pat. No. 6,474,125.

(51) Int. Cl.[7] ..... B21D 39/02

(52) U.S. Cl. ..... 72/306; 72/323; 72/312; 29/243.58

(58) Field of Search ..... 72/312–315, 323, 72/322, 387, 447, 306; 29/243.58, 243.57, 243.5

(56) References Cited

U.S. PATENT DOCUMENTS

| | | | | | |
|---|---|---|---|---|---|
| 4,602,497 | A | * | 7/1986 | Wallis | 72/481 |
| 4,665,733 | A | * | 5/1987 | Wallis | 72/481 |
| 5,150,508 | A | * | 9/1992 | St. Denis | 29/463 |
| 5,454,261 | A | | 10/1995 | Campian | 72/384 |
| 5,488,880 | A | | 2/1996 | Sartorio | 74/424.8 B |
| 5,669,296 | A | | 9/1997 | Newton | 100/99 |
| 6,182,492 | B1 | | 2/2001 | Raffin et al. | 72/454 |
| 6,314,784 | B1 | * | 11/2001 | Iraragorri Eloriaga et al. | 72/323 |
| 6,446,478 | B1 | * | 9/2002 | Muller | 72/306 |

FOREIGN PATENT DOCUMENTS

| | | | |
|---|---|---|---|
| DE | 43 30 683 A1 | * | 3/1995 |
| EP | 0 820 822 A1 | * | 1/1998 |
| EP | 1 103 320 A1 | | 5/2001 |
| FR | 2296519 | * | 7/1975 |
| JP | 2-15830 | * | 1/1990 |
| JP | 4-8432 | * | 1/1992 |

* cited by examiner

*Primary Examiner*—Daniel C. Crane
(74) *Attorney, Agent, or Firm*—Gifford, Krass, Groh, Sprinkle, Anderson & Citkowski, P.C.

(57) ABSTRACT

A hemming machine having a stationary base and defining a work station. A lifting beam is vertically movably mounted to the base at the work station while a motor assembly moves the lifting beam between a raised and a lowered position. Two die cartridges, each having hemming tooling and a nest vertically movably mounted to the die cartridge, are horizontally movable relative to the base by a conveyor assembly. A conveyor motor selectively moves the die cartridges between a position laterally spaced from the work station and the work station. With the die cartridge positioned at the work station, a first clamp releasably secures the nest to the lifting beam while a second clamp assembly releasably secures the die cartridge to the base. With the nest secured to the lifting beam and the die cartridge secured to the base, hemming operations are performed at the work station in the conventional fashion.

16 Claims, 9 Drawing Sheets

HEMMING MACHINE WITH MOVABLE DIE CARTRIDGES

CROSS REFERENCE TO RELATED APPLICATIONS

This is a continuation-in-part of U.S. patent application Ser. No. 09/861,067, filed May 18, 2001, now U.S. Pat. No. 6,474,125, and entitled "Hemming Machine with Dual Ball Screw Drive."

BACKGROUND OF THE INVENTION

I. Field of the Invention

The present invention relates generally to sheet metal hemming machines.

II. Description of Related Art

There are many previously known hemming machines. Many industries, such as the automotive industry, utilize sheet metal hemming machines to secure two sheet metal parts together. These sheet metal hemming machines typically comprise a base having a nest vertically slidably mounted relative to the base. The nest, in turn, supports the part to be hemmed.

At least one and typically three to five hemming die sets are laterally slidably mounted to the base and movable between an extended position and a retracted position. In the extended position, the die set overlaps the nest so that vertical displacement of the nest towards the hemming die causes the part to be hemmed to be compressed upon the die thus forming the hem. Typically, a prehem is first performed by a prehem die to bend the sheet metal at an angle of approximately 45° while a final hem die retrorsely flattens the sheet metal hem together.

In order to form the hem, the part to be hemmed is first positioned on the nest and, with the hemming dies retracted, the nest is moved to a position just below the prehem die and clearing the part flange to be hemmed. The prehem die is then moved to an extended position after which the nest is displaced vertically upwardly against the prehem die and retracted after having reached the nominal hemming pressure. The hemming dies are then moved to a retracted position and the nest is moved to a position just below the final hem die. The final hem die is then moved to an extended position and the nest is vertically displaced against the final hem die to complete the hem. The dies are then moved to their retracted position after retraction of the nest once reaching the final hem pressure and the part is removed from the nest and replaced by a new unhemmed part.

One disadvantage of these previously known hemming machines is that the entire hemming machine is designed specifically for one part to be hemmed. As such, it has been previously difficult, if not altogether impossible, to retrofit the hemming machine to accommodate other or different parts to be hemmed.

A still further disadvantage of these previously known hemming machines is that periodic maintenance, repair and the like of the hemming machine is oftentimes required. Furthermore, such maintenance and/or repair typically involves the hemming tooling or die sets that are mounted to the base. When such maintenance and/or repair of the hemming tooling is required, it is necessary to shut down the operation of the entire hemming machine. This, in turn, disadvantageously results in work stoppages or slowdown for the assembly line.

SUMMARY OF THE PRESENT INVENTION

The present invention provides a hemming machine which overcomes all of the above-mentioned disadvantages of the previously known hemming machines.

In brief, the hemming machine according to the present invention comprises a stationary base mounted on a ground support surface. The base has a work station at which the parts to be hemmed are processed.

A lifting beam is vertically slidably mounted to the base at the work station so that the lifting beam is movable between a raised position and a lowered position. Preferably, ball screws are utilized to mount the lifting beam to the base while an electric motor is drivingly connected to the ball screws to effect the vertical movement of the lifting beam.

The present invention further comprises two die cartridges, each of which are substantially rectangular in shape, having a central through opening. The hemming tooling or die sets are mounted to the die cartridges and preferably to the upper surface of the die cartridges so that the hemming tooling or die sets move in unison with the die cartridge.

Each die cartridge, furthermore, includes a nest vertically mounted within its respective through opening. If desired, the die cartridges as well as their associated nests may be designed to process the same part or, alternatively, may contain different hemming tooling and different nests to accommodate different parts.

A conveyor assembly is provided for laterally movably mounting the die cartridges relative to the base such that each die cartridge with its associated nest is movable between a first position in which the die cartridge and its associated nest are positioned in alignment with the work station, and a second position in which the die cartridge and its associated nest are laterally spaced from the work station. Any conventional means, such as a chain or belt drive, may be utilized to move the die cartridges with their associated nests between the first and second positions.

With one die cartridge with its associated nest positioned at the first position, i.e. in alignment with the work station, the main ball screw servo-motor is actuated thus lifting the lifting beam into engagement with the nest. Thereafter, a first clamp assembly is actuated to secure the lifting beam and nest together so that the lifting beam and nest vertically move in unison with each other. In order to facilitate the proper alignment between the nest and the lifting beam, two or more alignment pins are provided on either the nest or the lifting beam which engage alignment holes formed in the other of the nest or lifting beam.

After the lifting beam and nest have been clamped together, the nest and die cartridge secured to it through four horizontal locking pins are lowered by the lifting beam until the die cartridge rests upon a support surface on the base. Thereafter, a second clamp assembly is actuated in order to firmly, but releasably, clamp the die cartridge to the base.

After the die cartridge has been clamped to the base, the nest clamped to the lifting beam by the first and second clamp assemblies and the four horizontal locking pins disengaged in between the nest and die cartridge, vertical displacement of the lifting beam vertically moves the nest relative to the die cartridge in order to perform the hemming operation. The hemming operation itself is conventional, i.e. first a prehem is formed on the part and then a final hem is performed on the part. Following completion of the hemming operation, the hemmed part is removed and replaced by an unhemmed part which is then hemmed in the conventional fashion.

When it is desired to use the hemming tooling on the other die cartridge with its nest, the die cartridge at the work station with its associated nest are laterally moved away from the work station to their second position. Thereafter, the other die cartridge with its associated nest is moved from its second position to its first position, i.e. in alignment with the work station, and the above process is repeated.

The primary advantage of the hemming machine of the present invention is that the hemming machine may be utilized to continuously hem parts even though maintenance and/or repair of the hemming tooling is required.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
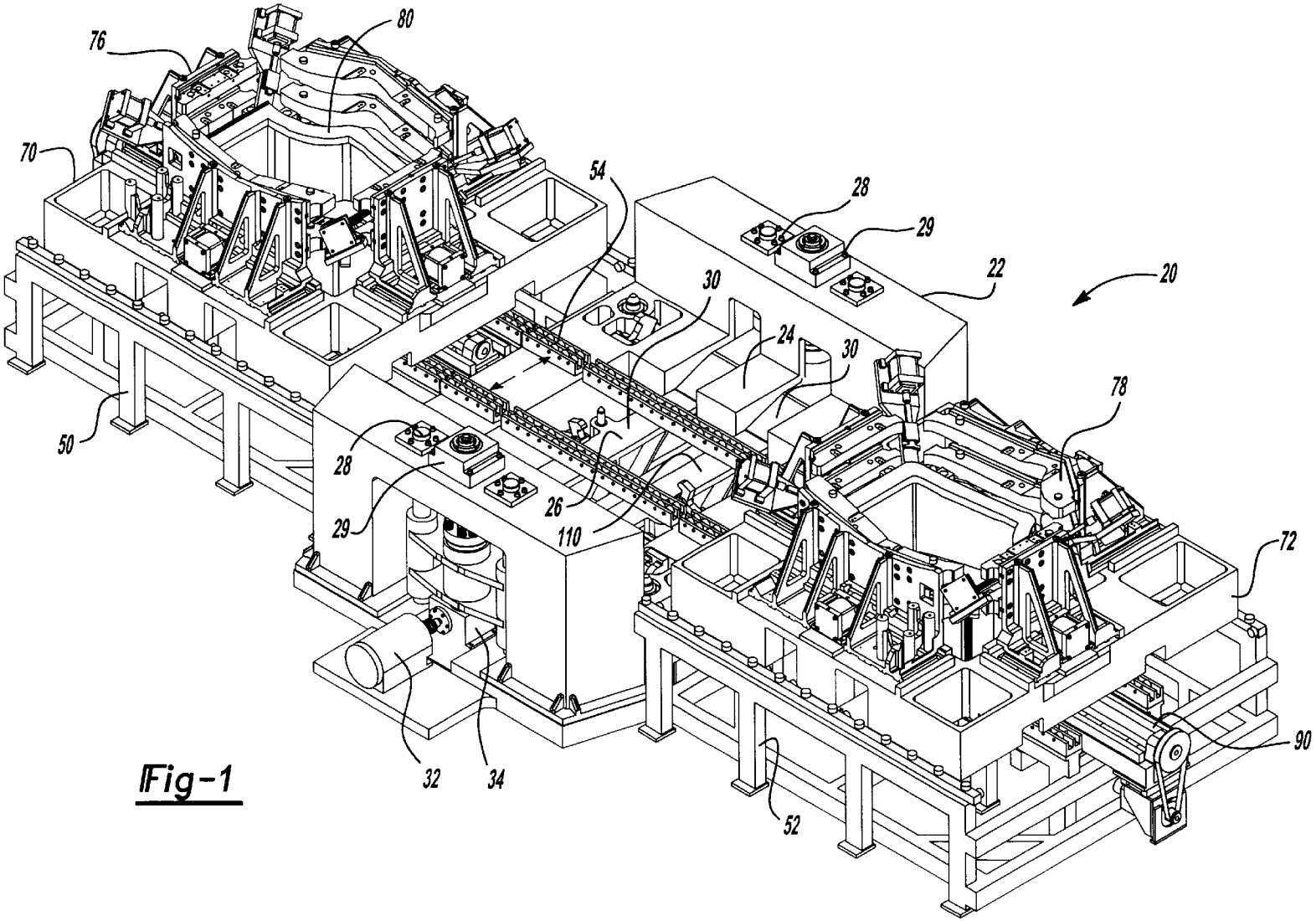
FIG. 1 is a perspective view illustrating a preferred embodiment of the present invention.

With reference first to FIG. 1, a perspective view of a hemming machine 20 having a base 22 supported on a ground surface is shown. The base 22 further includes a work station 24 at which the parts to be hemmed are positioned.

Figure 16:
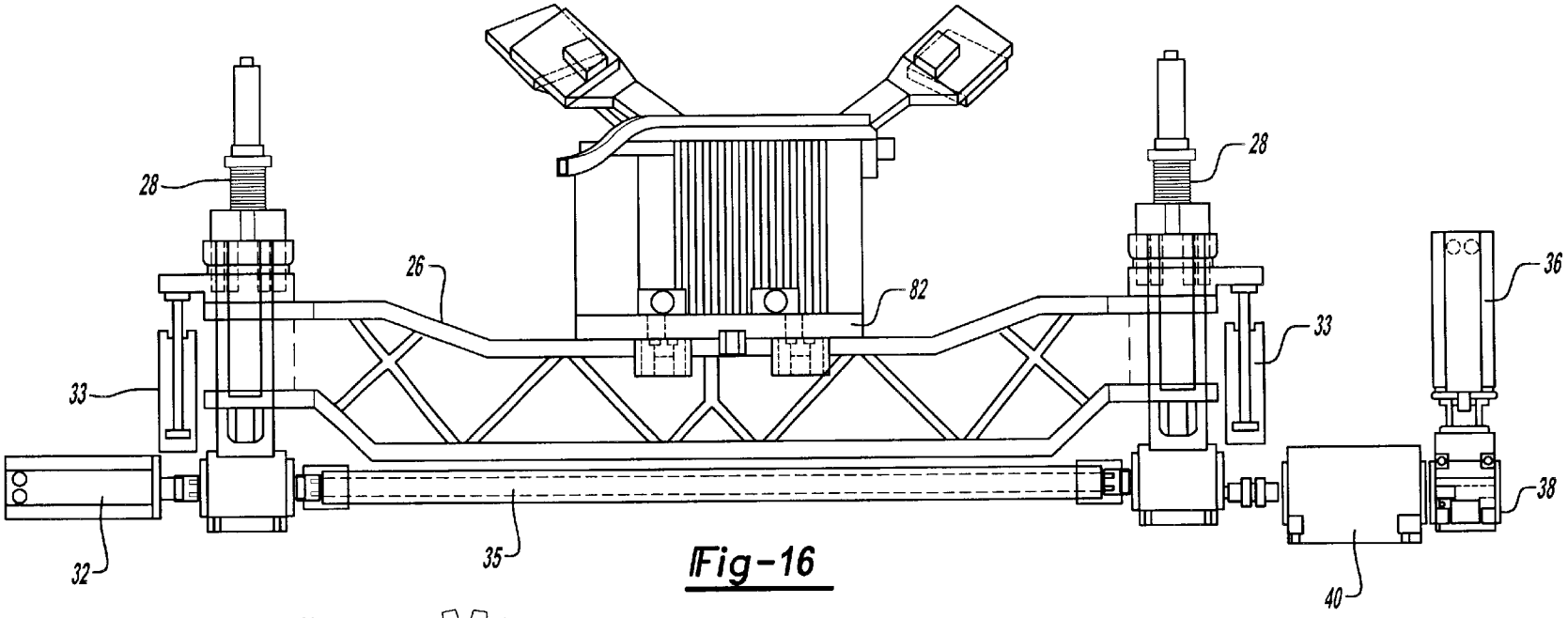
FIG. 16 is a side view illustrating the drive mechanism.

With reference to FIGS. 1 and 16, a lifting beam 26 is positioned at the work station 24 and is vertically movably mounted to the base 22 by a pair of spaced apart ball screws 28 which, in turn, are rotatably mounted to the base 22 by thrust bearings 29. The lifting beam 26, furthermore, preferably comprises a pair of spaced apart beams 30 which are secured together at each end.

A motor 32, preferably an electric servo-motor, is drivingly connected to each ball screw 28 through gear box 34 and a connecting shaft 35 (FIG. 16). As best shown in FIG. 16, an auxiliary motor 36 is also selectively drivingly connected to the ball screws 28 through a gear box 38 and clutch 40 in a fashion to be subsequently described in greater detail.

Figure 2:
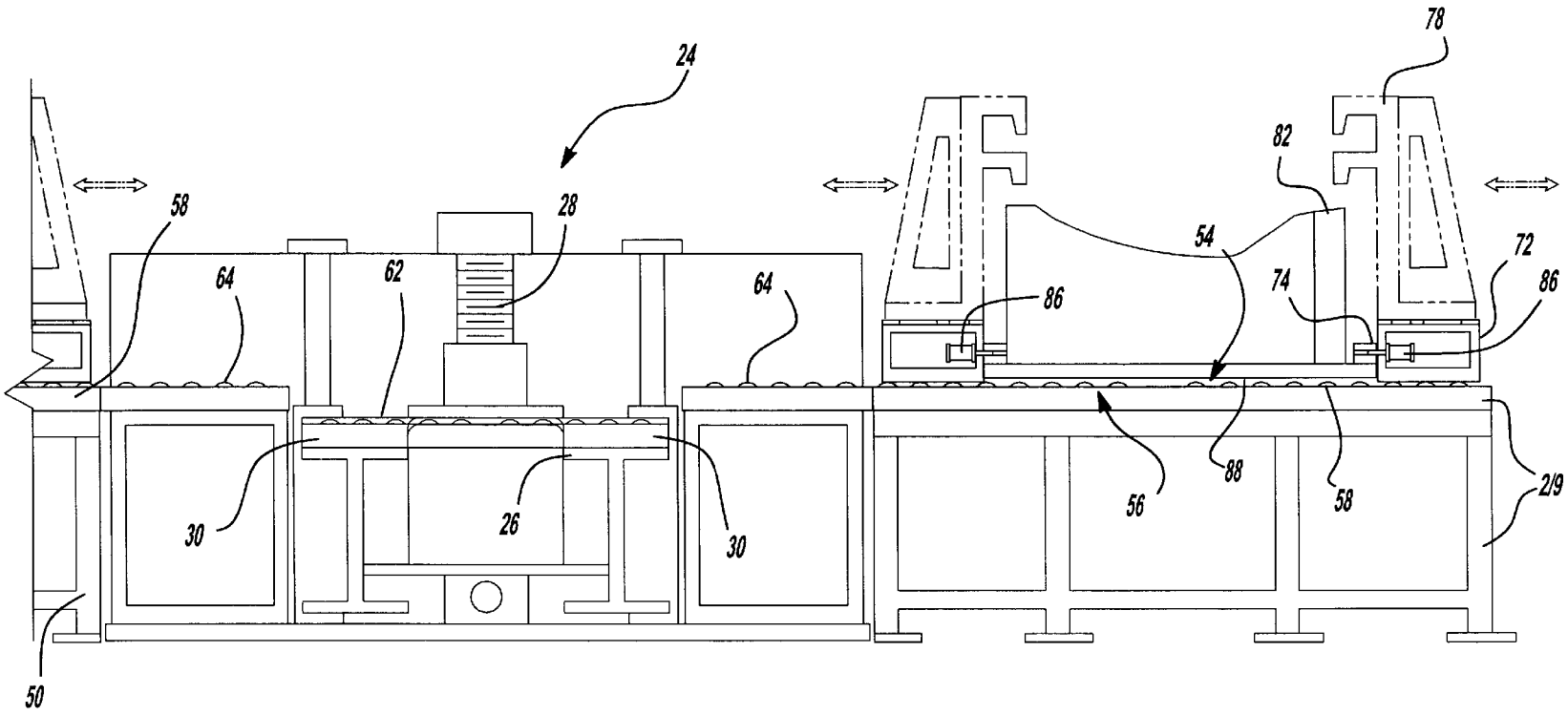
FIG. 2 is a side diagrammatic view illustrating the preferred embodiment of the present invention just prior to a change of the die cartridge.

Referring now to FIGS. 1 and 2, a first frame 50 is supported on the ground support surface at a position laterally spaced from the work station 24 while, similarly, a second frame 52 is also supported on the ground support surface on the opposite lateral side of the work station 24. A conveyor system 54 extends not only along an upper surface of both frames 50 and 52, but also across the work station 24.

As best shown in FIG. 2, the conveyor assembly 54 includes a pair of spaced apart conveyor rails 56. Furthermore, each conveyor rail 56 includes stationary sections 58 which are mounted to an upper surface of the frames 50 and 52. The conveyor rails 56 further include a lifting beam section 62 which is mounted to the lifting beam 26. Each conveyor rail 56 also includes two laterally movable sections 64 between the stationary sections 58 on the frames 50 and 52, and the lifting beam rail section 62. The operation of these movable rails 64 will be subsequently described in greater detail.

Still referring to FIGS. 1 and 2, the hemming machine 20 further comprises two die cartridges 70 and 72 which are generally rectangular in shape and each having a through opening 74 (FIG. 2). Both die sets 70 and 72 have a lower surface supported by the conveyors 54 so that the die cartridges 70 and 72 are laterally movable between a first position in which the die cartridge 72 is aligned with the work station 24, and a second position, illustrated in FIGS. 1 and 2, in which the die cartridges 72 are laterally spaced outwardly from the work station 24 and positioned above their respective frames 50 and 52.

Each die cartridge 70 and 72 includes hemming tooling 76 and 78, respectively. The hemming tooling 76 and 78 is preferably secured to an upper surface of the die cartridges 70 and 72, respectively, although the hemming tooling 76 and 78 may be secured to their respective die cartridges 70 and 72 in any conventional fashion so that the hemming tooling 76 and 78 move in unison with their respective die cartridges 70 and 72. Furthermore, the hemming tooling 76 and 78 may be symmetrical to each other for processing or hemming the left hand and right hand of the same type of part, or may be completely different from each other for processing or hemming different parts.

The hemming tooling 76 and 78, furthermore, is conventional in construction. As such, the hemming tooling 76 and 78 each include hemming dies which are laterally movable relative to their respective die cartridges 70 and 72 to perform both a prehem and final hem operation in the fashion that will subsequently be described in greater detail.

A nest 80 is disposed within the through opening 74 of the die cartridge 70 while, similarly, a nest 82 is disposed within the through opening 74 of the second die cartridge 72. In the conventional fashion, the nests 80 and 82 are adapted to support the part to be hemmed at their upper surface. Furthermore, during the hemming operation, the nests 80 and 82 are vertically movably mounted relative to their die cartridges 70 and 72, respectively, during the hemming operation.

The operation of the die cartridges 70 and 72 with their associated nests 80 and 82 are substantially identical to each other. Consequently, the operation of the die cartridge 72 with its associated nest 82 will be described in detail, it being understood that a like description shall also apply to the die cartridge 70 and nest 80.

With reference then particularly to FIG. 2, the hemming machine is there shown with the die cartridge 72 in its second position, i.e. spaced laterally outwardly from the work station 24. At this time, the lifting beam 26 is in a lower position such that the rail section 62 mounted to the lifting beam 26 is positioned below the rail sections 54 and 64.

Furthermore, with the die cartridge 72 in its second position, two or more horizontal locking pins 86 mounted to the die cartridge 72 engage the nest 82 to thereby secure the nest 82 to the die cartridge 72. Preferably, the horizontal locking pins 86 support the nest 82 relative to the die cartridge 72 so that a bottom surface 88 of the nest 82 is positioned upwardly from the conveyor rails 56. In doing so, the conveyor rails 56 support only the die cartridge 72 for lateral movement along the frame 52.

Figure 3:
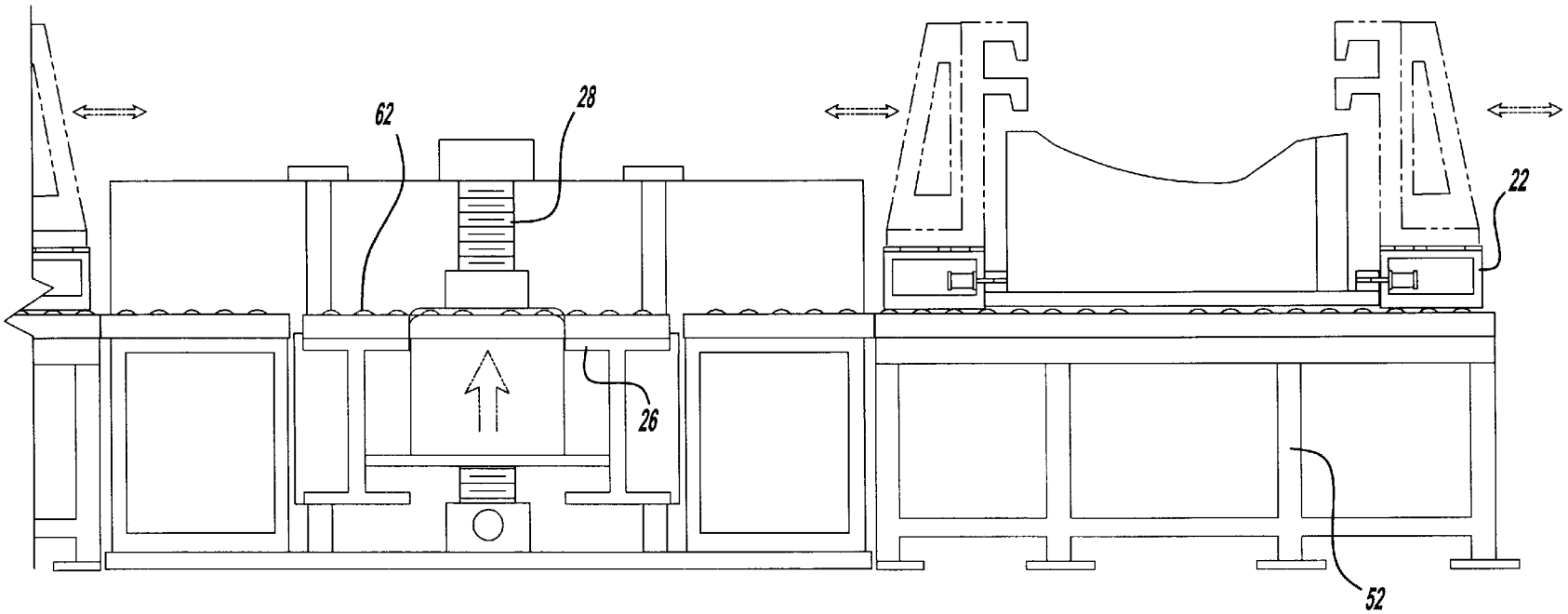
FIG. 3 is a view similar to FIG. 2 and illustrating a further step in the operation of the present invention.

With reference now to FIG. 3, the main servo-motor 32 (FIG. 1) is actuated to rotatably drive the ball screws 28 to move the lifting beam 26 to a position in which the lifting beam rail section 62 is aligned with the rail sections 58 and 64. At this time, the die cartridge 72 is still positioned in its second position and thus supported by the frame 52 and all conveyors are aligned.

Figure 4:
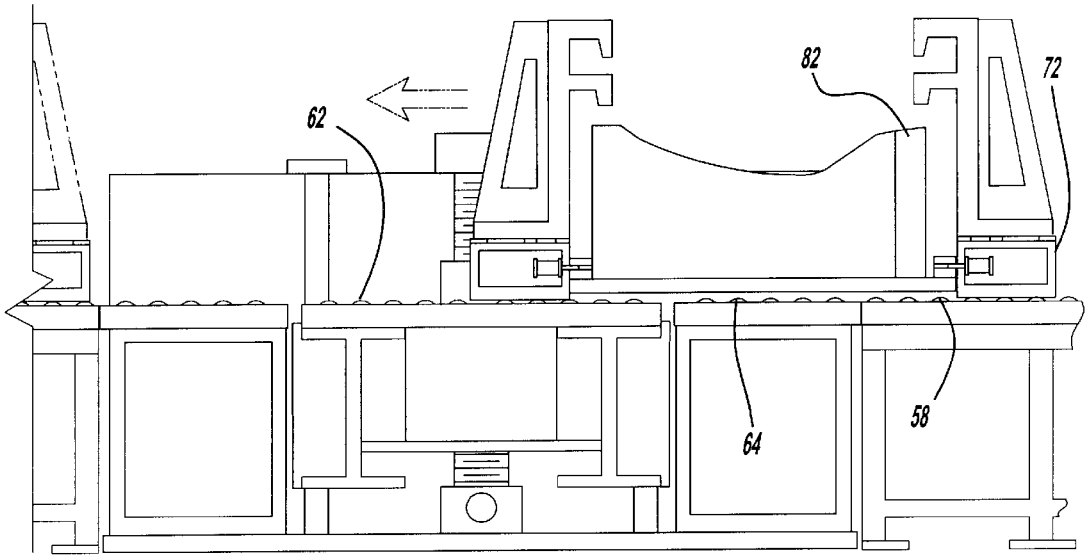
FIG. 4 is a view similar to FIG. 3 is and illustrating a further step of the operation of the present invention.
Figure 5:
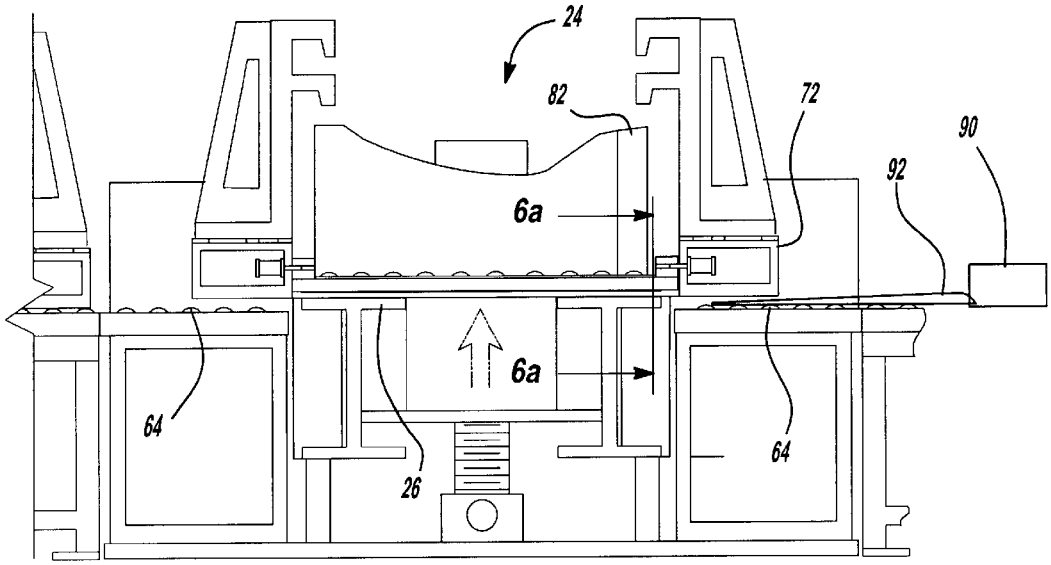
FIG. 5 is a view similar to FIG. 4 but illustrating a further step of the operation of the preferred embodiment of the present invention.

With reference now to FIGS. 4 and 5, the die cartridge 72 with its supported nest 82 is driven along the conveyor rail sections 58, 64 and 62 until the die cartridge 72 is positioned in its first position, i.e. in alignment with the work station 24 as depicted in FIG. 5. Any conventional means, such as a drive motor 90 and drive chain or belt 92 (FIGS. 1 and 5), may be utilized to longitudinally displace the die cartridge 72 with its supported nest 82 between its first and second positions. Alternatively, a ball screw, piston and cylinder and/or the like may be used to drive the die cartridge along the rail sections 58, 64 and 62.

With reference now particularly to FIG. 5, with the die cartridge 72 positioned in alignment with the work station 24, the main servo-motor 32 (FIG. 1) is again actuated thus lifting the lifting beam 26 so that the lifting beam 26 engages the nest 82 and elevates both the nest 82 with its attached die cartridge 72. In doing so, the die cartridge 72 is elevated above the moveable conveyor rail sections 64.

Figure 6A:
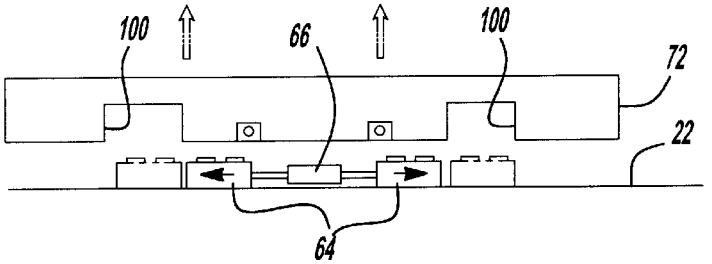
FIG. 6*a* is a sectional view taken along 6*a*—6*a* in FIG. 5 of the die cartridge supporting rail and with parts removed for clarity.
Figure 6B:
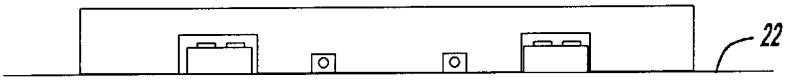
FIG. 6*b* is a view similar to FIG. 6*a* but illustrating a further step in the operation of the preferred embodiment of the present invention.

With reference now to FIGS. 6*a* and 6*b*, in FIG. 6*a* the die cartridge 72 is elevated above the movable rail segment 64 thus removing the weight of the die cartridge 72 and nest 82 from the moveable rail segment 64. Thereafter, an actuator 66 (FIG. 6*a*), which may be of any conventional construction such as a pneumatic actuator, laterally displaces the movable rail segment 64 laterally outwardly such that the rail segments 64 register with channels 100 formed in the die cartridge 72. Consequently, upon subsequent lowering of the die cartridge 72, the moveable rail sections 64 nest within the die cartridge channels 100 as shown in FIG. 6*b*.

Figure 7:
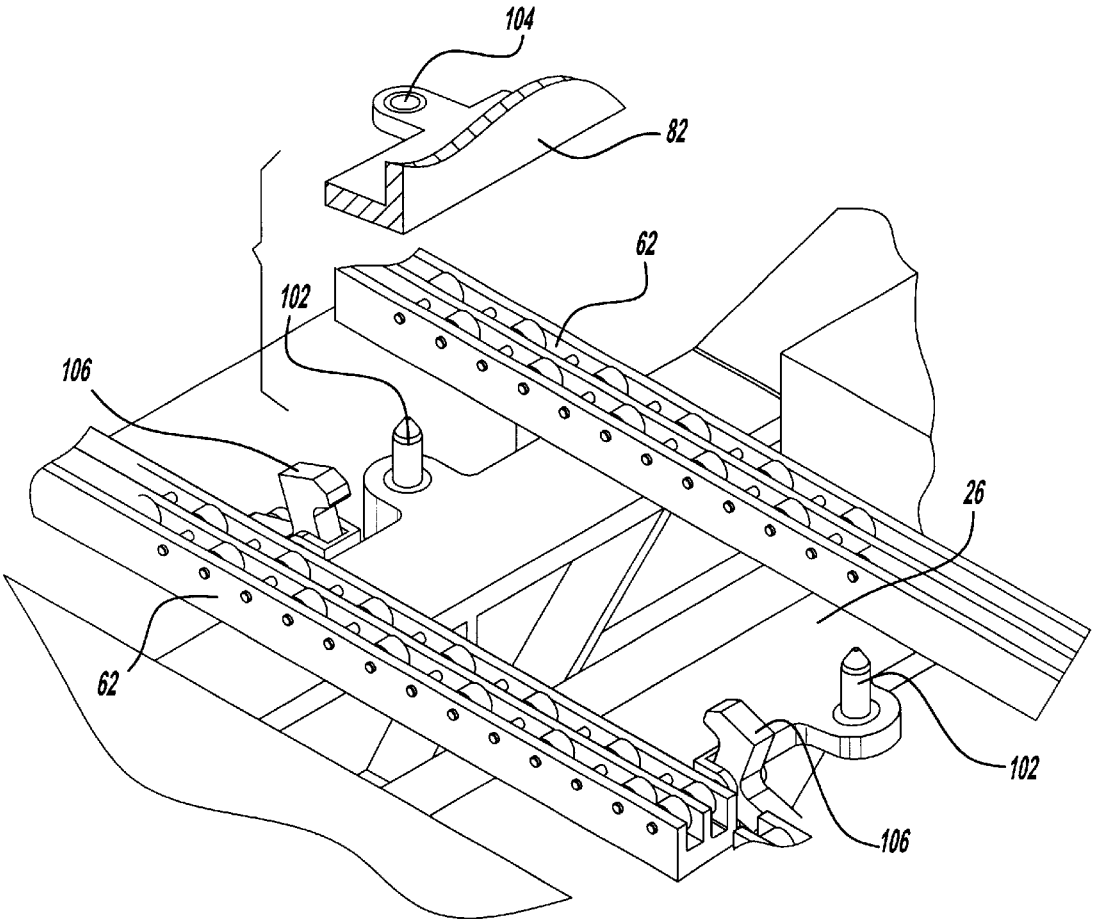
FIG. 7 is a partial fragmentary view illustrating a portion of the preferred embodiment of the present invention.

With reference now to FIG. 7, in order to properly align the nest 82 with the lifting beam 26 as the beam is moved to the position illustrated in FIG. 5, at least two alignment pins 102 are preferably secured to the lifting beam 26. These alignment pins 102 register with and engage alignment openings 104 (only one illustrated in FIG. 7) located in the nest 82 to ensure proper alignment of the nest 82 and lifting beam 26. Alternatively, of course, the alignment pins 102 can be secured to the nest 82 while the alignment holes 104 are formed in the lifting beam 26.

With reference now to FIGS. 5 and 7, after the lifting beam 26 has engaged the nest 82 and move the nest 82 to the position shown in FIG. 5, a pair of clamps 106 (FIG. 7) are actuated to firmly secure the nest 82 to the lifting beam 26. The clamps 106 may be of any conventional construction, but preferably comprise a pair of hooks pivotally mounted to the lifting beam 26 and movable between a clamped position and a release position by pneumatic actuators.

Figure 8:
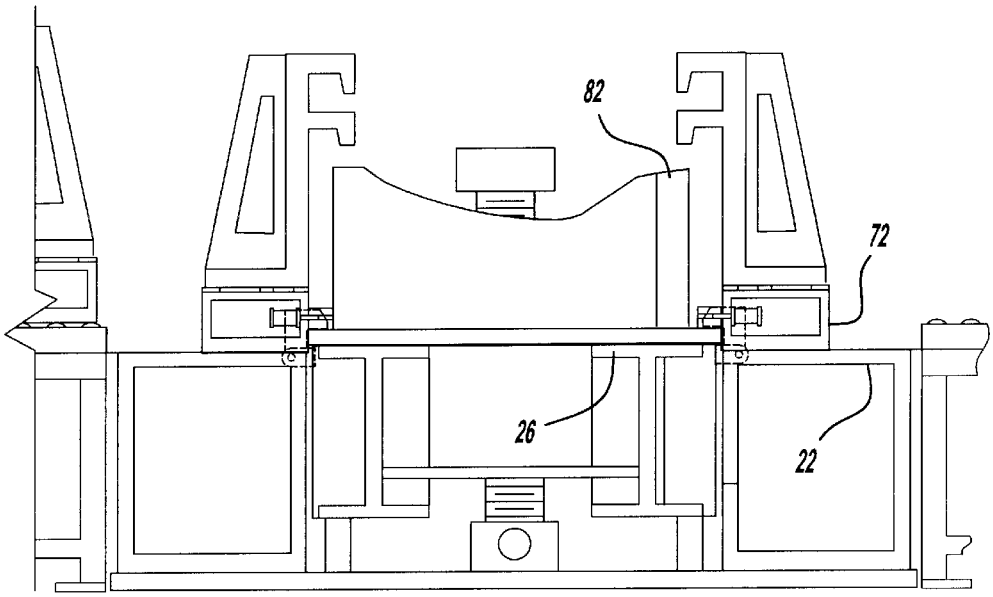
FIG. 8 is a view similar to FIG. 5 but illustrating a further step in the operation of the preferred embodiment of the present invention.
Figure 10:
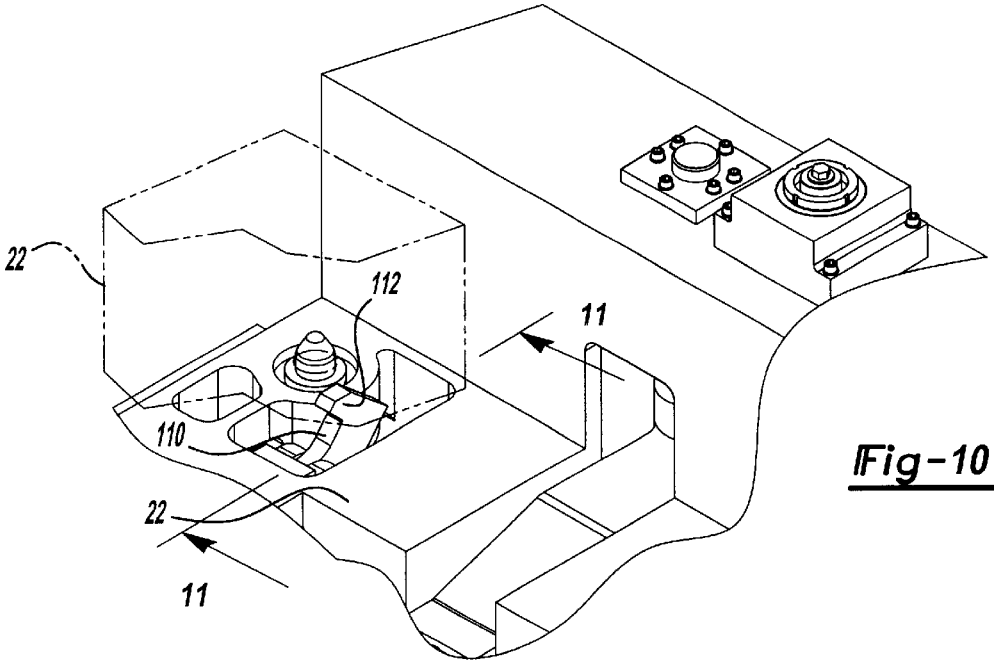
FIG. 10 is a fragmentary view illustrating a portion of the preferred embodiment of the present invention.
Figure 11:
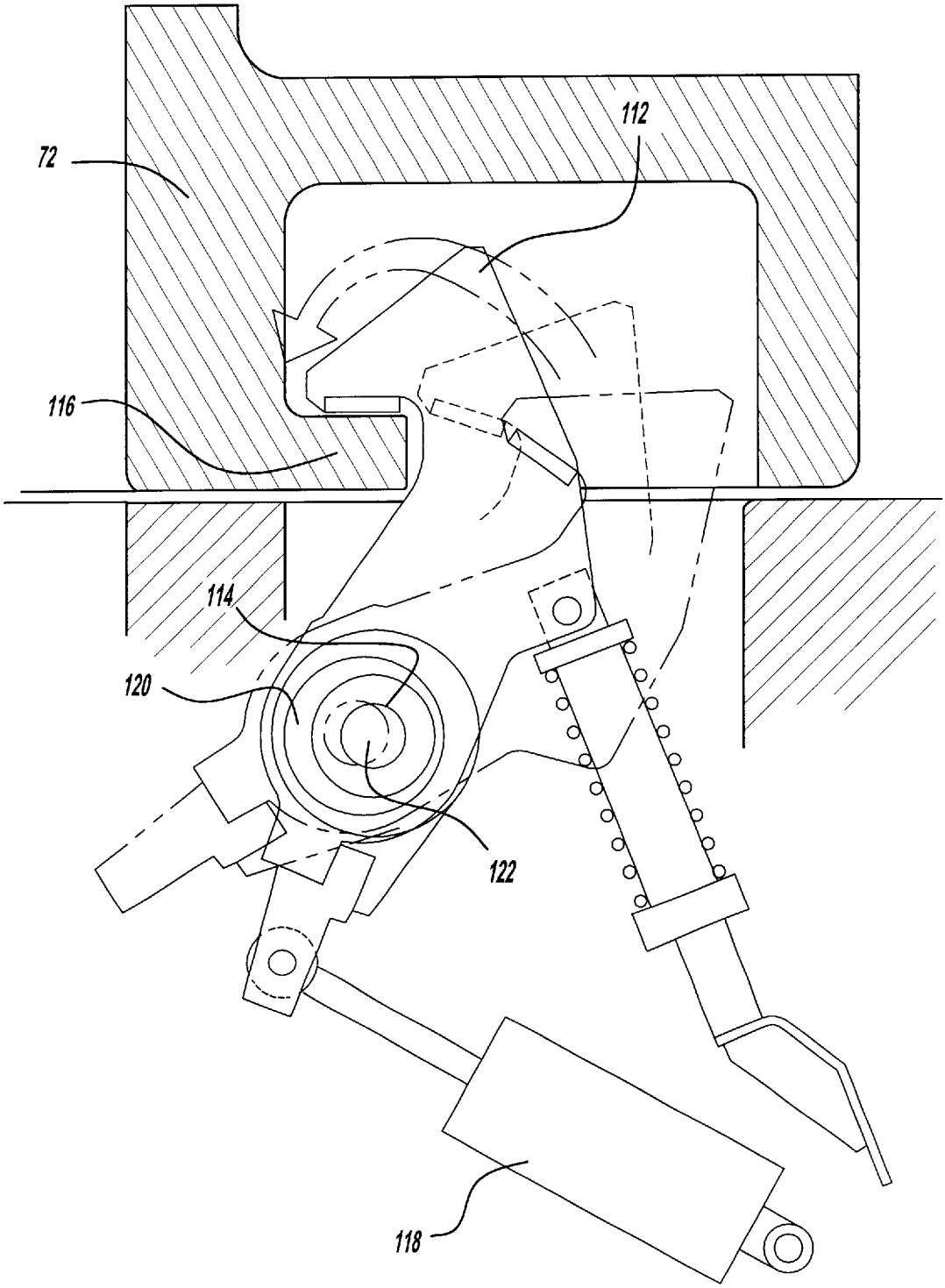
FIG. 11 is a view taken substantially along line 11—11 in FIG. 10 and enlarged and with parts removed for clarity.

With reference now to FIG. 8, after the lifting beam 26 has been secured to the nest 82 in the previously described fashion, the lifting beam 26 is lowered to the position illustrated in FIG. 8 in which the bottom of the die cartridge 72 is supported on an upper surface of the base 22. A clamp assembly 110 (FIGS. 1 and 10) is then actuated from an unclamped and to a clamped position in order to firmly clamp the die cartridge 72 against vertical movement to the base 22. With reference now to FIGS. 10 and 11, the clamp assembly 110 preferably comprises four hooks 112 (only one shown in FIGS. 1 and 10) with each hook positioned at each comer of the die cartridge 72. As best shown in FIG. 11, the hook 112 is movable between an unclamped position, illustrated in phantom line in FIG. 11, and a clamped position, illustrated in solid line in FIG. 11. The hook 112 is pivotally mounted by a bearing assembly 114 to the base 22 and, in its clamped position (solid line), engages a catch 116 formed on the die cartridge 72. Any conventional means, such as a pneumatic actuator 118, is used to pivot the hook 112 between its clamped and unclamped position. Furthermore, the bearing assembly 114 preferably engages an eccentric member 120 rotatably mounted between the hook 112 and the pivot shaft 122 secured to the base 22. This eccentric member 120 increases the downward force of the hook 112 against the catch 116 thereby firmly, but releasably, locking the die cartridge 72 against vertical movement relative to the base 22.

Figure 9:
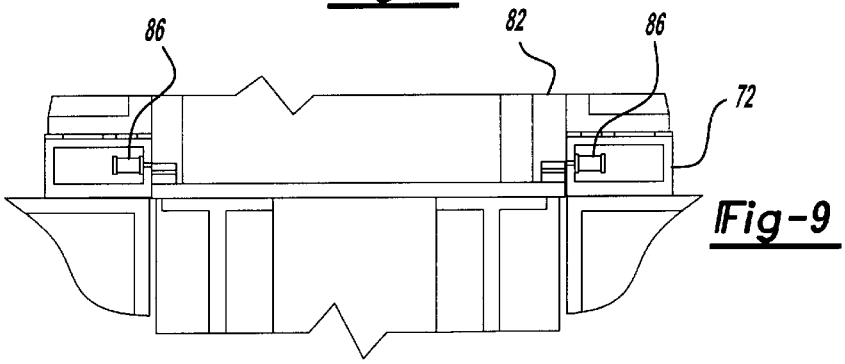
FIG. 9 is a fragmentary view illustrating a further step in the operation of the preferred embodiment of the present invention.

With reference now to FIG. 9, after the die cartridge 72 has been secured to the base 22 in the above-described fashion, the actuators 86 which secure the die cartridge 72 to the nest 82 are moved to their retracted or release position thus freeing the nest 82 for vertical movement relative to the die cartridge 72. Furthermore, at this time, the hemming machine 20 is ready to perform hemming operations.

With reference now to FIGS. 12–15, a hemming operation is briefly depicted for purposes of completeness only. However, it will be understood that the actual hemming operation is conventional in operation and well known to those skilled in the art.

Figure 12:
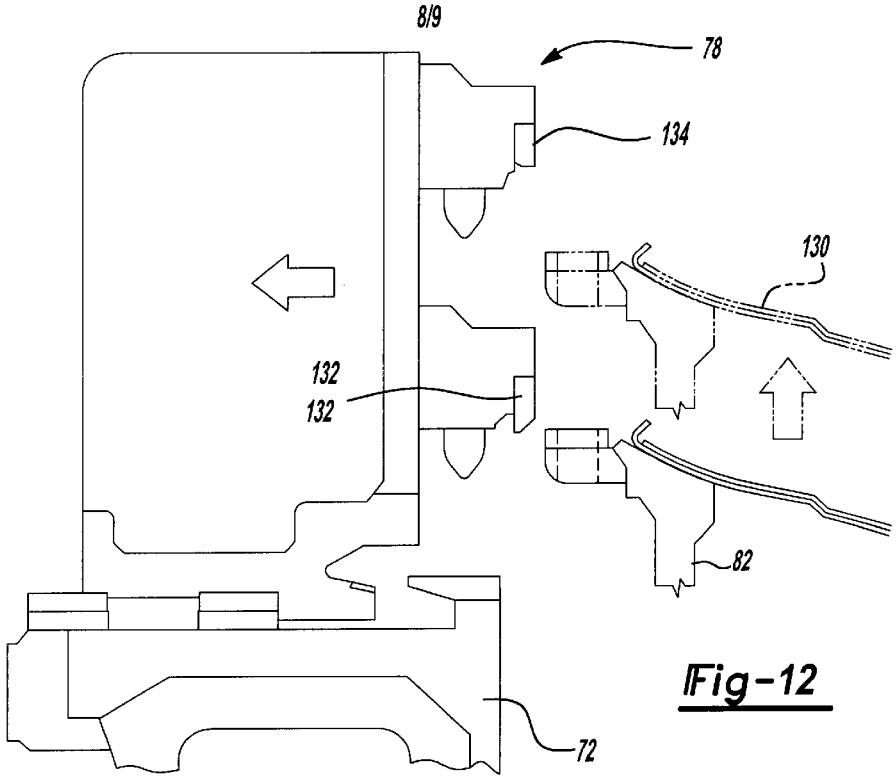
FIG. 12–FIG. 15 are all diagrammatic views illustrating a hemming operation.

As best shown in FIG. 12, the hemming tooling is laterally movably mounted to the die cartridge 72 between a position in which the hemming tooling 78 is spaced laterally outwardly from the nest 82, as shown in FIG. 12, and a position in which the hemming tooling 78 overlies both the nest 82 as well as the part 130 to be hemmed. Any conventional means may be utilized to laterally displace the hemming tooling 78 on the die cartridge 72. Furthermore, in the conventional fashion, the hemming tooling 78 includes both prehem tooling 132 as well as final hemming tooling 134.

After the prehem is formed as shown in FIG. 12, the hemming tooling 78 is moved to its retracted position and the nest 82 is moved from its prehem position, illustrated in solid line in FIG. 12, and its final hem position, illustrated in phantom line in FIG. 12.

Figure 13:
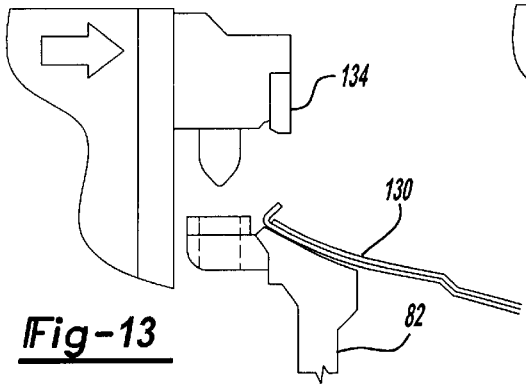
Figure 14:
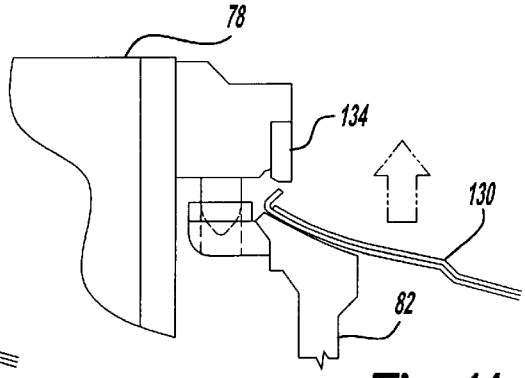
Figure 15:
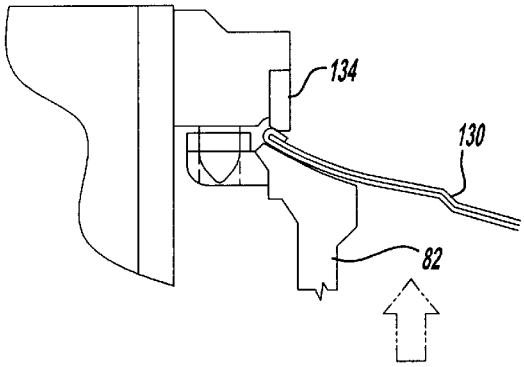

Thereafter, as shown in FIG. 13, the hemming tooling 78 is moved so that the final hemming tooling 134 overlies the prehem. Thereafter, the main servo-motor 32 (FIG. 1) is actuated to move the nest 82 so that the part 130 to be hemmed is positioned just below the final hemming tooling 134. The nest 82 is then elevated to the position shown in FIG. 15 in which the part 130 to be hemmed is compressed against the final hemming die 134 thus completing the hem. The nest 82 is thereafter lowered, the hemming tooling 78 retracted to its lateral outer position and the now hemmed part 130 is removed from the nest 82 and replaced by new parts to be hemmed.

With reference again to FIG. 16, a relatively high amount of force is required to compress the part 130 against the hemming dies 132 and especially 134 during the hemming operation. Conversely, a much smaller amount of power or torque is required to move the nest 82 between the hemming operations, especially if a counter-balancing device such as a nitrogen die spring as diagrammatically depicted in FIG. 16 is used.

Consequently, in order to increase the torque applied to the ball screws 28 only during the actual hemming operation, the clutch 40 is engaged and the auxiliary motor 36 is actuated only during the final phase of hemming operations, i.e. only when the part 130 is compressed against the hemming tools 132 or 134. The gearbox 38 also multiplies the torque output from the auxiliary motor 36 thereby generating sufficiently high torque to form the hem.

Figure 17:
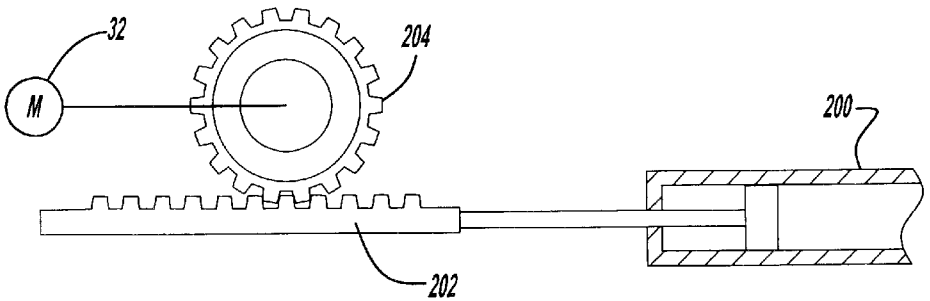
FIG. 17 is a diagrammatic view illustrating an alternate drive mechanism.

It will be understood, of course, that other means may be used to increase the final output torque from the motor during the actual prehem and final hem operations. For example, as shown in FIG. 17, a simple linear actuator 200, such as a pneumatic cylinder, is coupled to a rack 202. A pinion 204 is connected to the servo-motor 32. Consequently, activation of the actuator 200 augments the torque of the pinion 204.

Whenever it is desired to change the die cartridge 72 with the die cartridge 70, the above-identified process for moving and clamping both the die cartridge and nest within the work station is simply reversed. Once the die cartridge 72 is moved to a second position, i.e. spaced laterally outwardly from the work station 24, the other die cartridge 72 is moved into the work station 24 and secured in place in the previously described fashion for the die cartridge 72 with its nest 82. At that time, any required maintenance and/or repair of the die cartridge 72, its nest 82 or tooling 78 may be performed while the hemming machine 20 hems parts using the other die cartridge 70 and its associated nest 80 and tooling 76.

From the foregoing, it can be seen that the present invention provides a simple and yet highly effective hemming machine capable of using two separate nests and die sets. Having described my invention, however, many modifications thereto will become apparent to those skilled in the art to which it pertains without deviation from the spirit of the invention as defined by the scope of the appended claims.

What is claimed is:

1. A hemming machine comprising:

a stationary base having a work station, a lifting beam, means for vertically movably mounting said lifting beam to said base at said work station, a motor assembly for moving said lifting beam between a raised position and a lowered position, two die cartridges, each die cartridge having hemming tooling mounted thereon, two nests, each nest having an upper surface adapted to support a part to be hemmed, one nest being vertically slidably mounted to one die cartridge and the other nest being vertically slidably mounted to the other die cartridge, a conveyor assembly for movably supporting said die cartridges to said base so that each die cartridge is movable between a first position in which the die cartridge with its associated nest is positioned in alignment with said work station and a second position in which said die cartridge with its associated nest is laterally spaced from said work station, means for selectively moving said die cartridges on said conveyor assembly between said first and second positions, a first clamp assembly which releasably secures said nest to said lifting beam when said nest is in said first position, and a second clamp assembly which releasably secures said die cartridge to said base when said die cartridge is in said first position, wherein said conveyor system comprises a roller conveyor system having two elongated spaced rails, and wherein each rail comprises at least two aligned rail segments, means for laterally slidably mounting at least one of said rail segments to said base between a first lateral position and a second lateral position, and an actuator for moving said at least one rail segment between said first lateral position and said second lateral position.

2. The invention as defined in claim 1 wherein each die cartridge is rectangular in shape and has a vertically extending through opening, said one nest being disposed in said through opening for each die cartridge.

3. The invention as defined in claim 2 and comprising means for selectively locking each said nest to its associated die cartridge.

4. The invention as defined in claim 3 wherein said locking means locks each said nest to its associated die cartridge so that a bottom surface of said nest is spaced upwardly from its associated die cartridge.

5. The invention as defined in claim 1 wherein each die cartridge includes a pair of parallel channels along a bottom surface of each said die cartridge, and wherein when said at least one rail segments are in said second lateral position, said at least one rail segments are aligned with said die cartridge channels.

6. The invention as defined in claim 1 and comprising at least two alignment pins attached to one of said lifting beam or said nest and at least two alignment holes formed in the other of said lifting beam or said nest, said alignment pins being received in said alignment holes when said first clamp assembly secures said nest to said lifting beam.

7. The invention as defined in claim 1 wherein said means for movably mounting said lifting beam to said base comprises a pair of spaced ball screws.

8. The invention as defined in claim 7 wherein said motor assembly comprises a main electric servo-motor drivingly connected to said ball screws.

9. The invention as defined in claim 8 wherein said motor assembly comprises a second auxiliary electric servo-motor and a clutch assembly for selectively drivingly connecting said second motor to said ball screws.

10. The invention as defined in claim 8 wherein said motor assembly comprises a pinion drivingly connected to a drive shaft of said electric servo-motor, a gear rack in mesh with said pinion, and a linear actuator which longitudinally drives said gear rack.

11. The invention as defined in claim 1 wherein said clamp assembly comprises a hook, means for pivotally mounting said hook to said base so that said hook is pivotable between an engaged position and a disengaged position, wherein said hook pivotal mounting means comprises an eccentric member and an actuator for pivoting said eccentric member between a first pivotal position and a second pivotal position.

12. The invention as defined in claim 1 wherein said lifting beam comprises a pair of spaced apart elongated beams secured together at each end.

13. The invention as defined in claim 7 wherein said movable mounting means comprises a counterbalancing gas spring.

14. The invention as defined in claim 8 comprising a gear box mechanically coupling said motor to each of said ball screws.

15. A hemming machine comprising:

a stationary base having a work station, a lifting beam, means for vertically movably mounting said lifting beam to said base at said work station, a motor assembly for moving said lifting beam between a raised position and a lowered position, two die cartridges, each die cartridge having hemming tooling mounted thereon, two nests, each nest having an upper surface adapted to support a part to be hemmed, one nest being vertically slidably mounted to one die cartridge and the other nest being vertically slidably mounted to the other die cartridge, a conveyor assembly for movably supporting said die cartridges to said base so that each die cartridge is movable between a first position in which the die cartridge with its associated nest is positioned in alignment with said work station and a second position in which said die cartridge with its associated nest is laterally spaced from said work station, means for selectively moving said die cartridges on said conveyor assembly between said first and second positions, a first clamp assembly which releasably secures said nest to said lifting beam when said nest is in said first position, and a second clamp assembly which releasably secures said die cartridge to said base when said die cartridge is in said first position, wherein said means for movably mounting said lifting beam to said base comprises a pair of spaced ball screws, wherein said motor assembly comprises a main electric servo-motor drivingly connected to said ball screws, and wherein said motor assembly comprises a second auxiliary electric servo-motor and a clutch assembly for selectively drivingly connecting said second motor to said ball screws.

16. A hemming machine comprising:

a stationary base having a work station, a lifting beam, means for vertically movably mounting said lifting beam to said base at said work station, a motor assembly for moving said lifting beam between a raised position and a lowered position, two die cartridges, each die cartridge having hemming tooling mounted thereon, two nests, each nest having an upper surface adapted to support a part to be hemmed, one nest being vertically slidably mounted to one die cartridge and the other nest being vertically slidably mounted to the other die cartridge, a conveyor assembly for movably supporting said die cartridges to said base so that each die cartridge is movable between a first position in which the die cartridge with its associated nest is positioned in alignment with said work station and a second position in which said die cartridge with its associated nest is laterally spaced from said work station, means for selectively moving said die cartridges on said conveyor assembly between said first and second positions, a first clamp assembly which releasably secures said nest to said lifting beam when said nest is in said first position, and a second clamp assembly which releasably secures said die cartridge to said base when said die cartridge is in said first position, wherein said motor assembly comprises a main electric servo-motor drivingly connected to said ball screws, and a pinion drivingly connected to a drive shaft of said electric servo-motor, a gear rack in mesh with said pinion, and a linear actuator which longitudinally drives said gear rack.

* * * * *